US009052143B2

(12) United States Patent
Janowski et al.

(10) Patent No.: US 9,052,143 B2
(45) Date of Patent: Jun. 9, 2015

(54) APPARATUS FOR DRYING DISHES AND GLASSES

(71) Applicants: Joseph Dorone Janowski, Creskill, NJ (US); Yoram Janowski, London (GB)

(72) Inventors: Joseph Dorone Janowski, Creskill, NJ (US); Yoram Janowski, London (GB)

( * ) Notice: Subject to any disclaimer, the term of this patent is extended or adjusted under 35 U.S.C. 154(b) by 0 days.

(21) Appl. No.: 14/388,829

(22) PCT Filed: Mar. 21, 2013

(86) PCT No.: PCT/IL2013/000034
§ 371 (c)(1),
(2) Date: Sep. 29, 2014

(87) PCT Pub. No.: WO2013/150510
PCT Pub. Date: Oct. 10, 2013

(65) Prior Publication Data

US 2015/0082659 A1 Mar. 26, 2015

Related U.S. Application Data

(60) Provisional application No. 61/686,352, filed on Apr. 4, 2012.

(30) Foreign Application Priority Data

Nov. 5, 2012 (IL) ..... 222876

(51) Int. Cl.
*F26B 21/00* (2006.01)
*F26B 21/12* (2006.01)
*A47L 19/04* (2006.01)

(52) U.S. Cl.
CPC *F26B 21/12* (2013.01); *A47L 19/04* (2013.01)

(58) Field of Classification Search
CPC ..... F26B 19/00; F26B 21/00; F26B 25/00; F26B 25/16; A47L 11/00; A47L 11/22; A47L 11/32
USPC ..... 34/569, 73, 90, 174; 15/320, 339, 383; 134/25.2, 115 R
See application file for complete search history.

(56) References Cited

U.S. PATENT DOCUMENTS

| | | | | | |
|---|---|---|---|---|---|
| 1,681,322 | A | * | 8/1928 | Cave | 134/111 |
| 1,927,665 | A | * | 9/1933 | Kirby | 134/111 |
| 2,235,196 | A | * | 3/1941 | Bilde | 134/98.1 |
| 2,314,332 | A | * | 3/1943 | Ferris | 134/57 DL |
| 2,621,666 | A | * | 12/1952 | Hiort Af Ornas | 134/57 R |
| 3,106,930 | A | * | 10/1963 | James | 134/186 |
| 3,457,929 | A | * | 7/1969 | Madden | 134/95.3 |
| 3,465,761 | A | * | 9/1969 | Grunewald et al. | 134/58 D |
| 4,781,206 | A | * | 11/1988 | Noren | 134/174 |

(Continued)

FOREIGN PATENT DOCUMENTS

| | | |
|---|---|---|
| GB | 2108253 | 5/1983 |
| JP | 2007/289366 | 11/2007 |

(Continued)

*Primary Examiner* — Stephen M Gravini

(57) ABSTRACT

An apparatus for drying dishes that comprises a rack, an air blower, an open drain trough, a sensor, and a system of tubules through which the air flows. The open drain trough has two vertical sides with perforations. The air flows from the air blower, through the system of tubules and into the open drain trough through the perforations in the sides of the open drain trough, so that when the sensor detects the presence of a dish in the open drain trough, the air blower is activated causing the air to dry the dish in the open drain trough.

6 Claims, 6 Drawing Sheets

(56) References Cited

U.S. PATENT DOCUMENTS

| | | | | |
|---|---|---|---|---|
| 5,168,885 | A * | 12/1992 | Tromblee et al. | 134/105 |
| 5,341,827 | A * | 8/1994 | Kim | 134/107 |
| 5,882,739 | A * | 3/1999 | Kobos et al. | 427/536 |
| 6,327,994 | B1 * | 12/2001 | Labrador | 114/382 |
| 6,578,586 | B2 * | 6/2003 | Moh | 134/25.2 |
| 6,705,330 | B1 * | 3/2004 | Favret | 134/56 D |
| 7,103,992 | B2 * | 9/2006 | Duden et al. | 34/381 |
| 7,254,901 | B2 * | 8/2007 | Blann et al. | 34/595 |
| RE40,123 | E * | 3/2008 | Johansen et al. | 34/62 |
| 7,367,134 | B2 * | 5/2008 | Osvatic et al. | 34/62 |
| 7,604,012 | B2 * | 10/2009 | Alpert et al. | 134/58 D |
| 7,635,003 | B2 * | 12/2009 | Lee | 134/25.2 |
| 7,676,954 | B2 * | 3/2010 | Classen et al. | 34/486 |
| 7,931,033 | B2 * | 4/2011 | Park et al. | 134/108 |
| 8,758,525 | B2 * | 6/2014 | Kim | 134/57 D |
| 8,869,424 | B2 * | 10/2014 | Hermann et al. | 34/486 |
| 2002/0153021 | A1 * | 10/2002 | Audet | 134/1 |
| 2007/0039200 | A1 * | 2/2007 | Hwang | 34/474 |
| 2010/0012163 | A1 * | 1/2010 | Alpert et al. | 134/58 D |
| 2015/0082659 | A1 * | 3/2015 | Janowski et al. | 34/569 |

FOREIGN PATENT DOCUMENTS

| | | | | |
|---|---|---|---|---|
| JP | 2008253542 | A * | 10/2008 | |
| JP | 2009247458 | A * | 10/2009 | |
| WO | WO 9833427 | A1 * | 8/1998 | A47L 15/48 |
| WO | WO 2013150510 | A1 * | 10/2013 | |

* cited by examiner

APPARATUS FOR DRYING DISHES AND GLASSES

RELATED APPLICATIONS

This application is a National Phase of PCT Patent Application No. PCT/IL2013/000034 having International filing date of 21 Mar. 2013, which claims the benefit of priority under 35 USC §119(e) of U.S. Provisional Patent Application Nos. 61/686,352 filed on 4 Apr. 2012 and IL Patent Application No. 222876 filed on 5 Nov. 2012. The contents of the above applications are all incorporated by reference as if fully set forth herein in their entirety.

TECHNICAL FIELD

The present invention refers to an apparatus for drying dishes and glasses that is based on the use of an air blower.

BACKGROUND ART

After hand washing dishes, such as plates, glasses and cutlery, it is customary to place them in a dish drying rack and wait for them to dry naturally. In the present application, the expression "to dry naturally" means that dishes are dried in a way whereby the residual water on the dishes evaporates into the air with no special assistance. When a dishwasher is used, it is customary to leave the dishes in the dishwasher to dry naturally. There are, however, many people who prefer, for a variety of reasons, to dry the dishes quickly and not wait for them to dry naturally. Some people may, for instance, want their dishes to dry quickly in order to remove them from the dish drying rack and put them away in the cupboard immediately after they are washed. When glasses are involved, and especially in the case of wine glasses with long stems, the problem is even more acute since they cannot be left in the dish drying rack safely since they tend to break easily and make it difficult to place other dishes in the dish drying rack. The present invention offers an effective solution to the problem of drying dishes and glasses in a quick, efficient and safe manner.

DESCRIPTION OF THE DRAWINGS

The intention of the drawings attached to the application is not to limit the scope of the invention and its application.

The drawings are intended only to illustrate the invention and they constitute only one of its many possible implementations.

Figure 1:
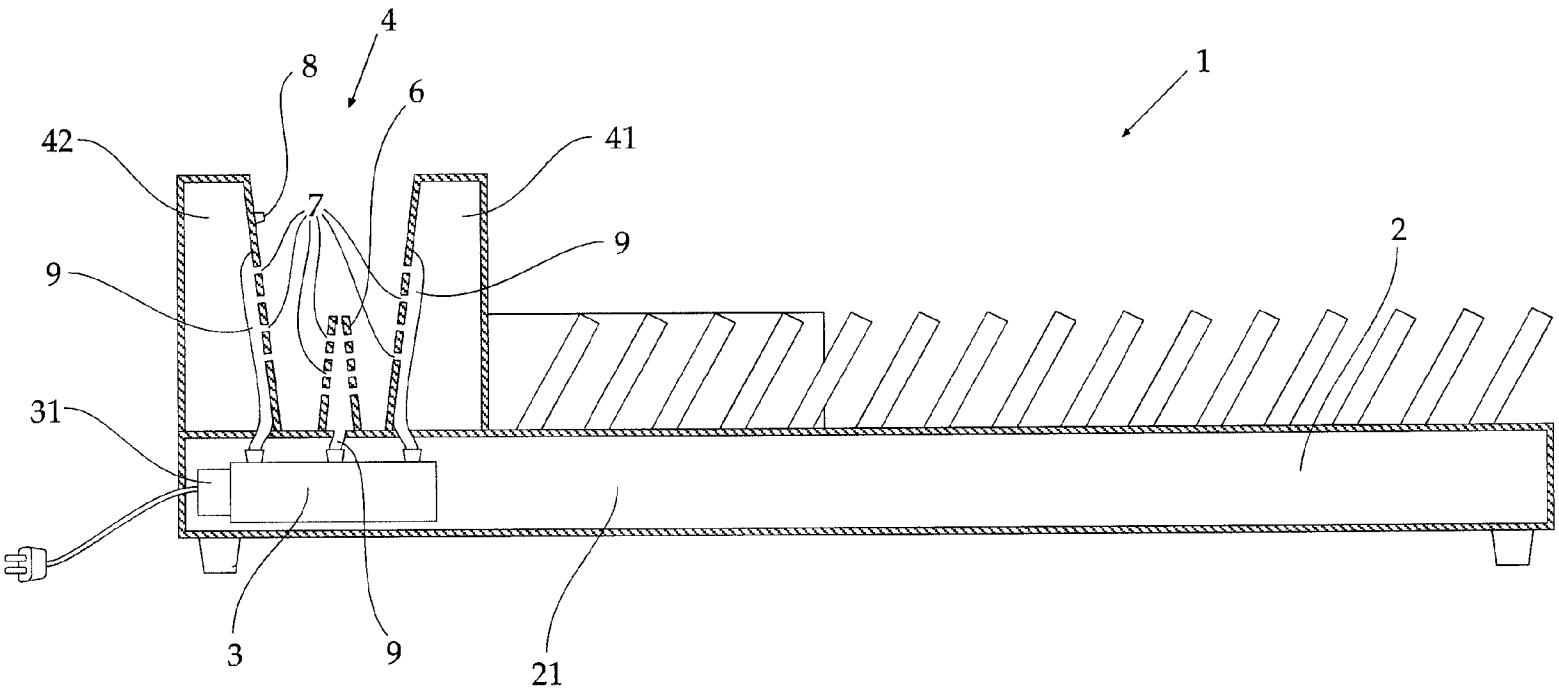
Figure 2:
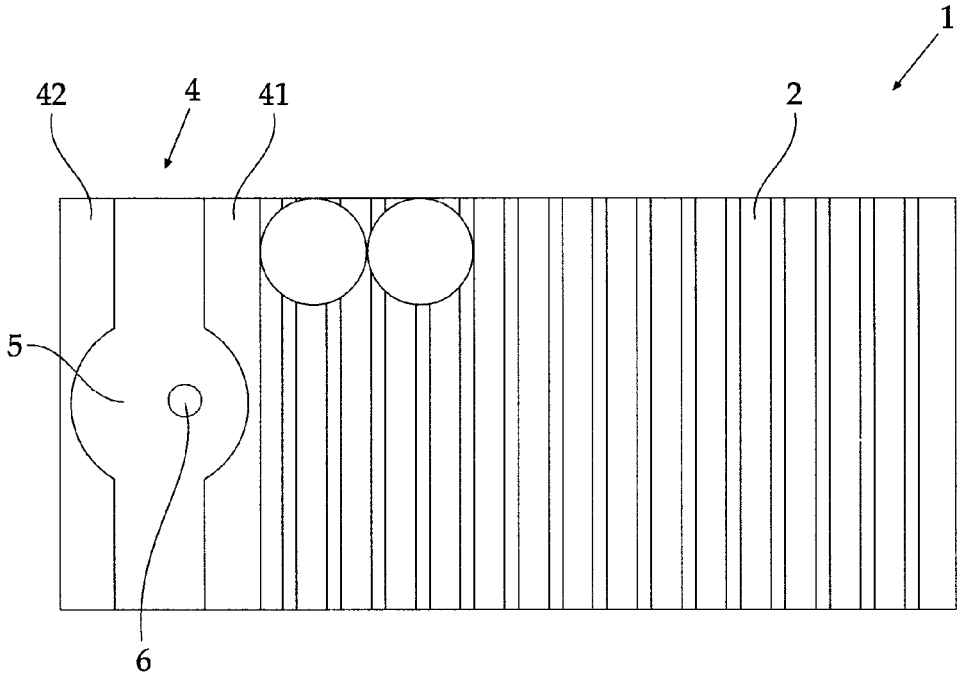
Figure 3:
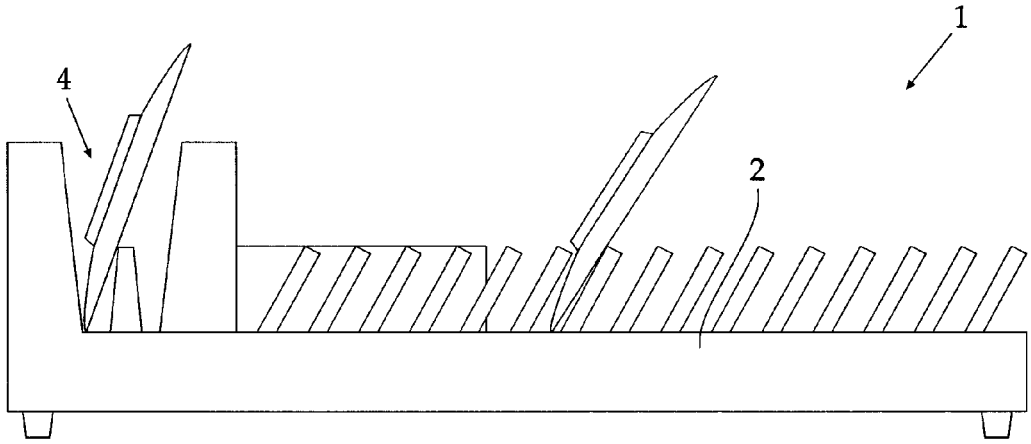
Figure 4:
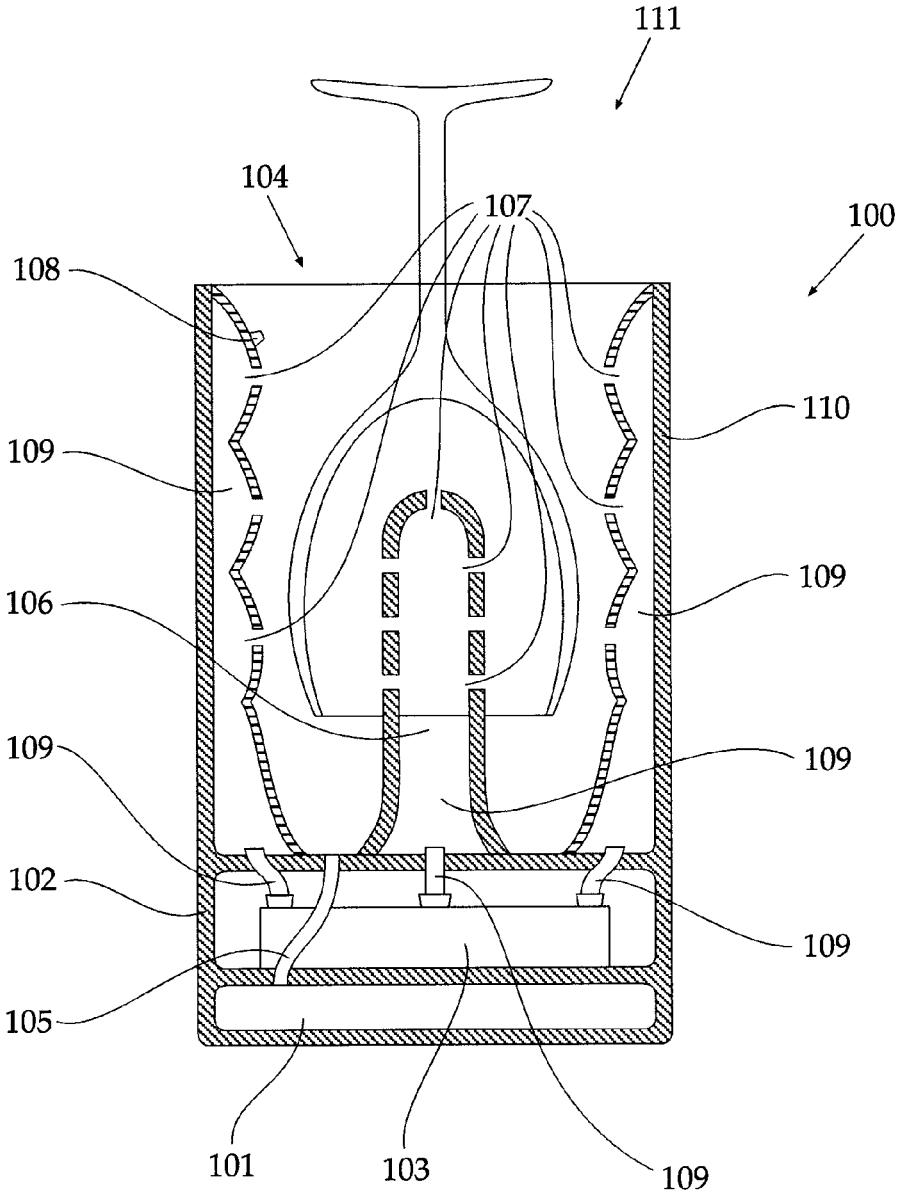
Figure 5:
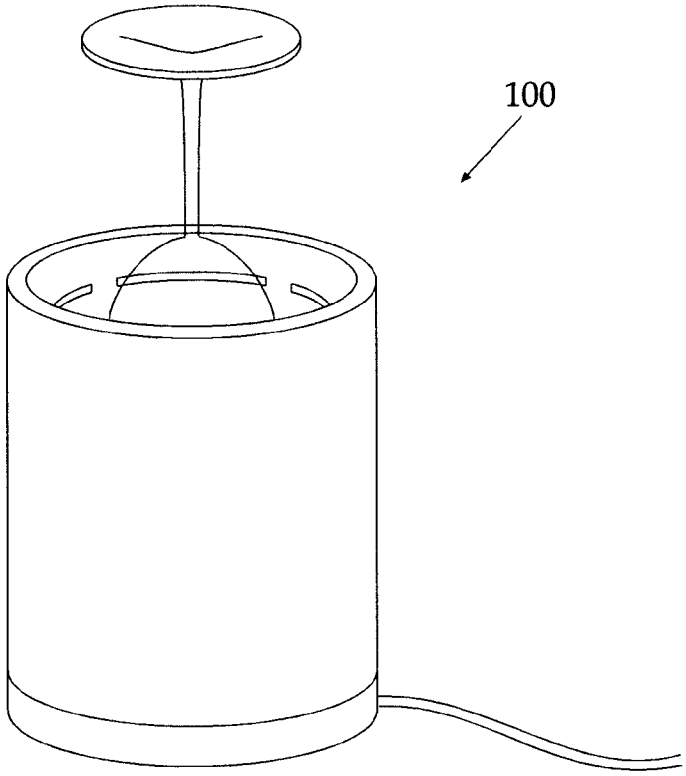
Figure 6:
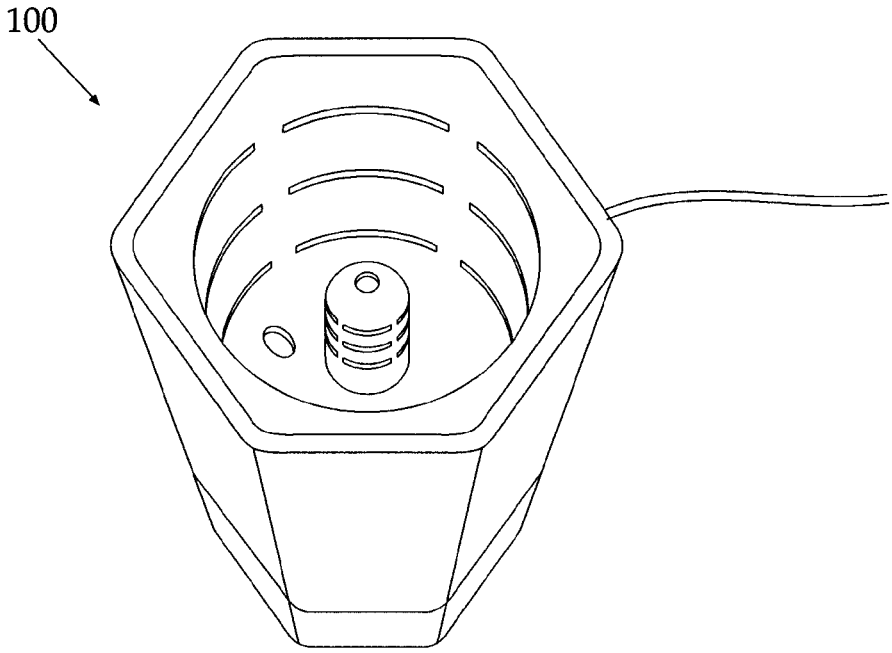

Drawing No. 1 presents a cross section of the dish drying apparatus (1) that comprises a rack (2), an air blower (3) that is installed in the base of the rack (21), two vertical sides (41) (42) that together form an open drain trough (4), perforations (7), a transformer (31) and a system of ducts and tubules (9) that channel the air from the air blower to the perforations (7).

Drawing No. 2 presents a view from above of the dish drying apparatus (1) that comprises a rack (2), an open drain trough (4) that is made up of two vertical sides (41) (42), a round recess (5) and a drying cone (6).

Drawing No. 3 presents a side view of the dish drying apparatus (1) with two plates: one in the open drain trough (4) and one in the regular dish drying rack (2).

Drawing No. 4 presents a cross section of the glass drying apparatus (100) that comprises a hollow cylindrical casing (110) with a top opening (111), an inner cavity (104), an air blower (103), a drying cone (106), a sensor (108), a drain chamber (101), a drain tubule (105), a system of ducts or tubules through which the air flows (109), and perforations (107).

Drawing No. 5 depicts the glass drying apparatus (100) with a wine glass in it.

Drawing No. 6 depicts the glass drying apparatus (100) from above.

Drawing No. 7 presents a perspective view of the apparatus (1000), which comprises the base (2000), two sides (41) and (42), a recess (5) and a drying cone (6).

Drawing No. 8 presents the apparatus (1000) from above.

Figure 9:
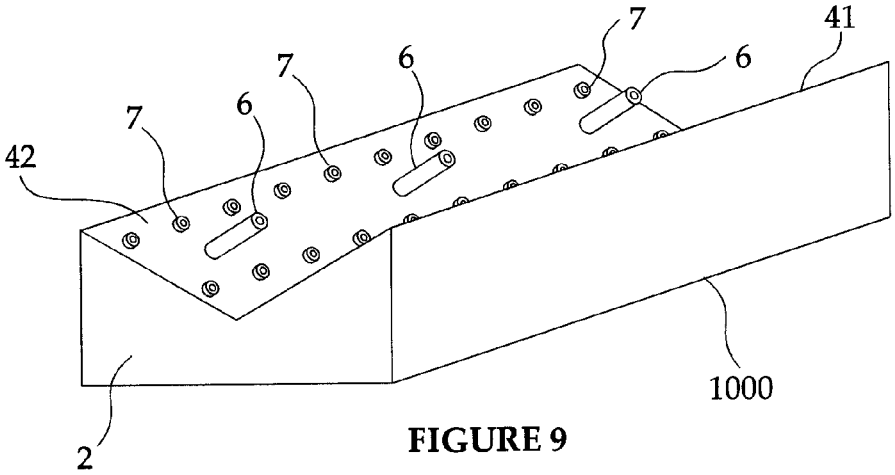

FIG. 9 presents a perspective view of the apparatus (10000), which comprises the base (20000), two sides (41) and (42) and a drying cone (6).

Figure 10:
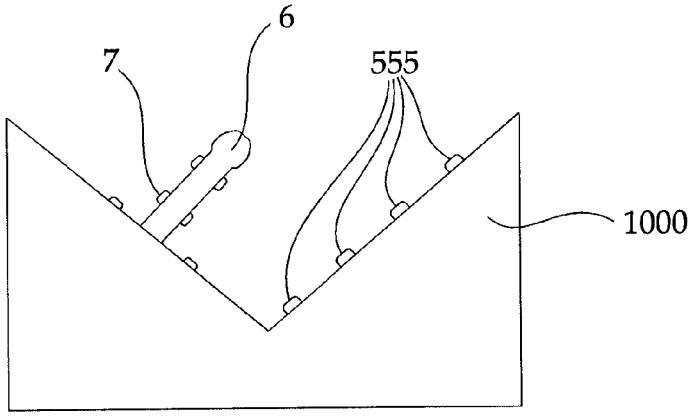
Figure 11:
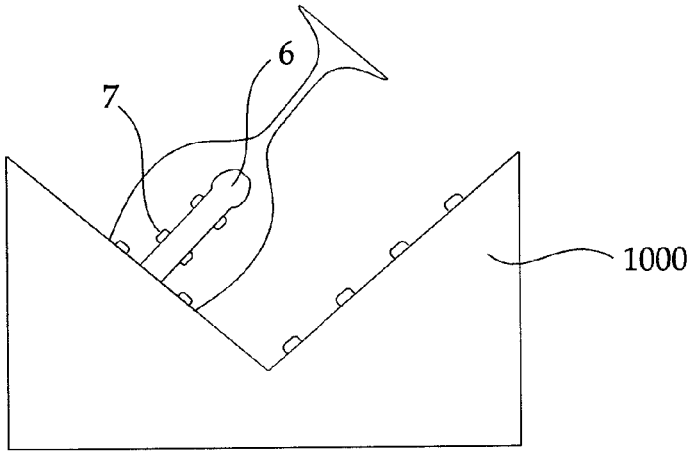

FIGS. 10 and 11 present the apparatus (10000) from side view.

THE INVENTION

The main objective of the present invention is to provide a dish drying apparatus (1) that is based on an air blower. Another objective of the present invention is to provide a glass drying apparatus (100) that is based on an air blower.

The dish drying apparatus (1) comprises a rack (2), an air blower (3), an open drain trough (4) with two sides (41) (42) through which air flows at a high pressure, a sensor (8), and a system of ducts or tubules (9) that channels the air through the apparatus. The apparatus (1) can also include a recess (5) and a drying cone (6).

The rack (2) is an integral part of the apparatus (1) and is designed and assembled like a standard dish drying rack.

The air blower (3) can be any kind of air blower that is currently known or that will be known in the future, although the inventors believe that a high intensity blower such as Dyson's Airblade™ should be used.

The open drain trough (4) is made up of two sides (41) (42) whereby the space between them forms the open drain trough. There are perforations (7) in both sides (41) (42). The air blower (3) is concealed in the base (21) of the rack. Compressed air flows from the air blower (3), through the ducts or tubules (9) and out through the perforations (7) in the sides (41) (42) into the open drain trough (4). When the air blower (3) is activated, high-pressure air flows at a high velocity from the air blower (3) through the ducts or tubules (9) and out through the perforations (7) into the open drain trough (4). The sensor (8) is located in the open drain trough (4), for instance on one of the sides (41) (42), so that when a dish is placed in the open drain trough (4), the sensor (8) activates the air blower (3).

Drawing No. 1 presents a cross section of the apparatus (1) comprising a rack (2), an air blower (3) that is concealed in the base (21) of the rack (2), two sides (41) and (42) that form the open drain trough (4), perforations (7) in the sides of the trough (41) (42), a transformer (31), and a system of ducts or tubules (9) through which air flows from the blower (3) to the perforations (7).

Using the apparatus (1): After washing dishes, the user may place the washed dishes in the rack (2) so that they may dry in a natural manner, or, if the user wishes to dry the dishes immediately, he or she may place them directly in the open drain trough (4). The user can also hold the dish during the drying process rather than placing it. In any case, the sensor (8) detects the presence of a dish in the open drain trough (4) and activates the air blower (3). Within a very short time, the said dish is dry and can be used or stored in the cabinet. When the sensor (8) detects removal of the dish from the open drain trough (4), it sends a deactivation command to the air blower (3).

The open drain trough (4) is adjacent to the rack (2) and it is possible that its longitudinal axis is parallel to the longitudinal axes of the rack dividers, so that when the user places one plate in the rack (2) and one plate in the open drain trough (4), the two plates are parallel to one another. The fact that the dishes are inserted into the open drain trough (4) from above and the fact that the open drain trough (4) is adjacent and parallel to the dividers on the rack (2), enables the apparatus to be used in a convenient and efficient manner, since, among other things, the same arm movements used to place the dishes in the rack (2) are used to place the dishes in the open drain trough (4).

The recess (5): To use the open drain trough (4) for drying cutlery in a convenient and efficient manner, the sides (41) (42) of the open drain trough (4) can and should be designed with a recess (5) into which the user may insert a wire basket containing washed, wet cutlery. Drawing No. 2 presents a view from above of the apparatus (1) with an open drain trough (4) and a recess (5) in its center.

The recess (5) can, in fact, be of any shape and it does not have to be round. The recess (5) can be of a variety of shapes such as elliptical, round, square and so on.

The drying cone (6), depicted in Drawings Nos. 1 and 2, is a cone with perforations (7) through which air flows from the blower (3), through the internal ducts or tubules (9). When the user places a glass over the drying cone (6), air flows on both inside and outside the glass, causing the glass to dry quickly. It is possible that the drying cone (6) be located on the bottom of the recess (5) and preferably adjacent to one of the sides (41) or (42) so that the cutlery basket may be placed in the recess (5) without being hindered by the drying cone (6).

The apparatus can and should be equipped with an electronic component that activates the air blower (3) the moment the sensor (8) detects the presence of a dish in the open drain trough (4), and deactivates the air blower (3) after a preset time, in case the user forgets to remove the dish from the open drain trough (4) after it is dry.

Using the apparatus (1) offers many advantages, among other things, thanks to the ease with which the user can place the dishes in the open drain trough (4), as explained above and as depicted in Drawing No. 3, the option of using the apparatus to dry both the inside and outside of glasses, and the option of using the apparatus to dry cutlery using a wire basket.

The glass drying apparatus (100) comprises a hollow cylindrical casing (110) with a top opening (111), an inner cavity (104) through which air flows at a high pressure, an air blower (103), a drying cone (106), a sensor (108), a drain compartment (101), a drain tubule (105), and a system of internal ducts or tubules (109) through which air flows from the blower (103) to the inner cavity (104).

Drawing No. 4 presents the glass drying apparatus (100) in cross section. The air blower (103) is concealed in the base (102) and is activated when the sensor (8) located in the inner cavity (104) detects the presence of a glass. The sides of the inner cavity (104) have perforations (107) through which compressed air flows from the air blower (103) through a system of ducts or tubules (109) into the inner cavity (104). A drain tubule (105) is connected to the bottom of the inner cavity (104) and drains the water that drips from the glass into the drain compartment (101) located at the bottom of the cylindrical casing (110). When the sensor (108) detects the removal of the glass from the inner cavity (104) it sends a deactivation command to the air blower (103).

The drying cone (106) is a cone with perforations (107) through which air flows from the blower (103) through a system of ducts or tubules (109). The drying cone (106) enables air from the air blower to flow onto the inside of the glass while air flows out of the perforations (107) in the sides of the inner cavity (104) onto the outside of the glass.

The apparatus can and should be equipped with an electronic component that activates the air blower (103) the moment the sensor (108) detects the presence of a glass in the inner cavity (104), and deactivates the air blower (103) after a preset time, in case the user forgets to remove the glass from the inner cavity (104) after it is dry.

Using the apparatus (100): After washing glasses, the user may place the washed glasses in the rack to dry in a natural manner, or, if the user wishes to dry the glasses quickly, he or she may place them in the inner cavity (104). The sensor (108) detects the presence of a glass in the inner cavity (104) and activates the air blower (103) and within a very short time, the glass in the inner cavity (104) is dry and can be used or stored in the cupboard.

Using the glass drying apparatus (100) offers many advantages, among other things, thanks to its relatively very small size, as depicted for instance in Drawing No. 5, to its ability to dry both the inside and the outside of glasses, and to the fact that when placed in the glass drying apparatus (100), the glasses are stable and safe and there is no fear of them falling and breaking. The apparatus (100) has another advantage in that it includes a drain system that drains the water that accumulates at the bottom of the inner cavity (104).

Note: In the following Claims, we use the term "tubules" to refer to internal ducts, spaces and tubules or to any other means that enable the air to flow from the air blower to the perforations.

Another embodiment of the present invention is the dish drying apparatus (1000), which is similar in principle to the apparatus (1) but differs from it in that it stands alone and is not a part of a tray or a rack. Drawings Nos. 7 and 8 depict the apparatus (1000), which comprises a base (2000), an open drain trough (4) with two sides (41) (42) in which the air blower (3) and the system of ducts or tubules (9) are located, a recess (5) and a drying cone (6).

Figure 7:
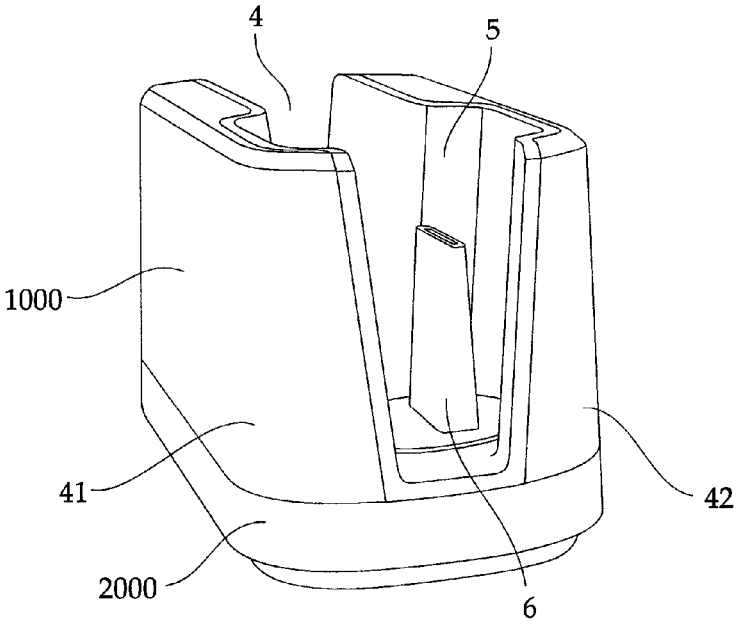
Figure 8:
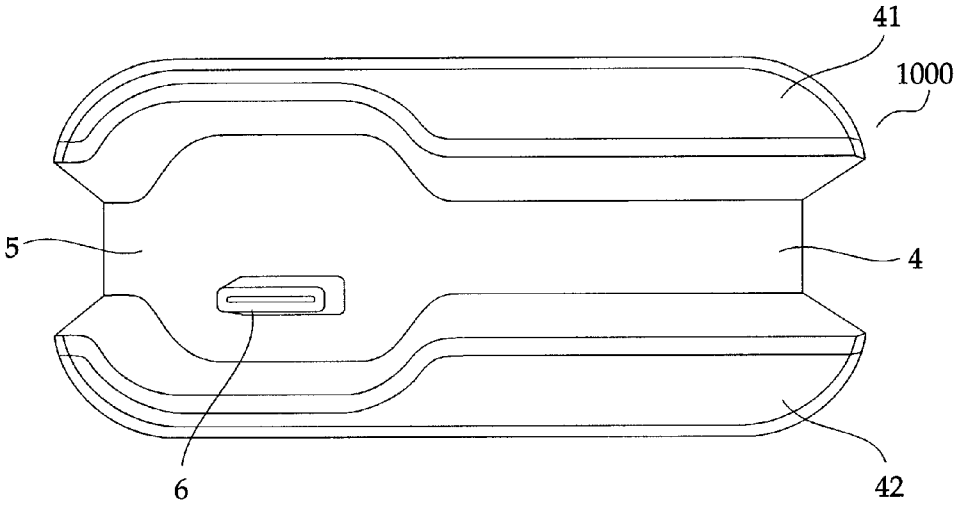

FIG. 7 presents a perspective view of the apparatus (1000), which comprises the base (2000), two sides (41) and (42), a recess (5) and a drying cone (6). FIG. 8 presents the apparatus (1000) from above.

Another embodiment of the invention is the dish drying apparatus (10000), which is similar in principle to the apparatus (1) but differs from it in that it stands alone and is not a part of a tray or a rack and also it is differs from apparatus (1000) in that it is not included a specified recess due to the fact that the sides (41) (42) are connected in a V shape. It is also recommended that a least one of the sides (41 (42) includes several short bumps (555) so the plates that lean on that side will not block the perforations (7). FIGS. 9-11 depict the apparatus (10000), which comprises a base (20000), an open drain trough (4) with two sides (41) (42) in which the air blower (3) and the system of ducts or tubules (9) are located and a drying cone (6).

FIG. 9 presents a perspective view of the apparatus (10000), which comprises the base (20000), two sides (41) and (42) and a drying cone (6). FIGS. 10 AND 11 present the apparatus (10000) from side view.

The apparatuses (1) (100) (1000) (10000) are also needed for wine or Champagne glasses, which cannot be placed in a dishwasher due to the length of their stems, and which are sometimes made of materials that are not suitable for cleaning in a dishwasher, crystal, for instance.

What is claimed is:

1. A dish drying apparatus comprises: a base, an air blower, an open drying trough, a sensor, and a system of tubules through which the air flows;

wherein the open drying trough is made up of two sides; wherein said two sides extend from said base; wherein the outer surfaces of said two sides define the edges of said apparatus; wherein said open drying trough is aimed to receive a dish for drying; wherein the air flows from the air blower, through said system of tubules, and into said open drying trough through perforations in the both sides of said open drying trough;

wherein the sensor activates said air blower when it detects the presence of a dish in said open drying trough, causing air from said air blower to flow through said tubules and said perforations of said sides into the open drying trough; wherein said air flows through said perforations from both said sides directly to the a dish that has been placed in said drying trough for drying said dish.

2. The apparatus described in claim 1 wherein said open drying trough also has a drying cone; wherein said drying cone is hollow and includes one or more perforations; wherein said drying cone is aimed to receive a glass for drying; wherein the air flows through said perforations into the inner part of said glass.

3. The apparatus described in claim 1 wherein the open drying trough also has a recess; wherein said recess constitutes a part of said open drying trough; wherein said recess is aimed to receive cutlery for drying.

4. The apparatus described in claim 1 wherein said open drying trough also has a recess combined with a drying cone.

5. The apparatus described in claim 1 wherein it also includes a rack and wherein said rack is an integral part of the apparatus.

6. A glass drying apparatus comprises: a hollow cylindrical casing with a top opening, an inner cavity through which air flows at a high pressure, an air blower, a drying cone, a sensor, a drain compartment, a drain tubule, and a system of tubules that channel the air from the air blower into the inner cavity; wherein the air blower is concealed in said cylindrical casing and is activated when the sensor detects the presence of a glass in the inner cavity; wherein the sides of the inner cavity includes perforations; wherein air flows from the air blower through the tubules into the inner cavity through said perforations; wherein the drying cone has perforations through which air flows from the air blower through the tubules; wherein said drain tubule is connected to the bottom of the inner cavity and drains water that drips from the glass into the drain compartment located at the bottom of the cylindrical casing; wherein the air flows directly both onto the outside and the inside of the glass in the inner cavity.

* * * * *